US009963960B2

(12) United States Patent
Tolman et al.

(10) Patent No.: US 9,963,960 B2
(45) Date of Patent: May 8, 2018

(54) SYSTEMS AND METHODS FOR STIMULATING A MULTI-ZONE SUBTERRANEAN FORMATION

(71) Applicants: Randy C. Tolman, Spring, TX (US); Timothy G. Benish, Conroe, TX (US); Geoffrey Steiner, Castle Rock, CO (US); Kris J. Nygaard, Houston, TX (US)

(72) Inventors: Randy C. Tolman, Spring, TX (US); Timothy G. Benish, Conroe, TX (US); Geoffrey Steiner, Castle Rock, CO (US); Kris J. Nygaard, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 319 days.

(21) Appl. No.: 14/437,163

(22) PCT Filed: Nov. 18, 2013

(86) PCT No.: PCT/US2013/070607
§ 371 (c)(1),
(2) Date: Apr. 20, 2015

(87) PCT Pub. No.: WO2014/099208
PCT Pub. Date: Jun. 26, 2014

(65) Prior Publication Data

US 2015/0285052 A1 Oct. 8, 2015

Related U.S. Application Data

(60) Provisional application No. 61/835,331, filed on Jun. 14, 2013, provisional application No. 61/745,144, filed on Dec. 21, 2012.

(51) Int. Cl.
*E21B 43/25* (2006.01)
*E21B 43/14* (2006.01)
(Continued)

(52) U.S. Cl.
CPC ..... *E21B 43/25* (2013.01); *E21B 33/12* (2013.01); *E21B 34/12* (2013.01); *E21B 43/119* (2013.01);
(Continued)

(58) Field of Classification Search
CPC ..... E21B 43/25; E21B 43/26; E21B 43/267
See application file for complete search history.

(56) References Cited

U.S. PATENT DOCUMENTS 3,437,147 A * 4/1969 Davies ..... C09K 8/72 166/193
5,234,055 A 8/1993 Cornette
(Continued)

OTHER PUBLICATIONS

Schlumberger Limited, "Falcon Hydraulic-Actuated Frac Valve," 2012, http://www.slb.com/resources/other_resources/product_sheets/completions/multistage_stimulation/hydraulic_actuated_frac_valve_ps.aspx.

*Primary Examiner* — Giovanna C. Wright
*Assistant Examiner* — Manuel C Portocarrero
(74) *Attorney, Agent, or Firm* — ExxonMobil Upstream Research Company—Law Department

(57) ABSTRACT

Methods for stimulating a subterranean formation comprising providing a stimulating fluid stream to a casing conduit that is defined by a production casing that extends within the subterranean formation to increase a fluid pressure within the casing conduit. The methods further include locating an isolation device on an isolation sleeve to fluidly isolate a downhole portion of the casing conduit from an uphole portion of the casing conduit and opening an injection port that is associated with the isolation sleeve to permit an
(Continued)

injection port fluid flow into the subterranean formation. The methods also include sealing the injection port and creating an uphole perforation in the uphole longitudinal section of the production casing responsive to the fluid pressure exceeding the threshold perforating pressure.

34 Claims, 8 Drawing Sheets

(51) Int. Cl.

| | |
|---|---|
| ***E21B 43/26*** | (2006.01) |
| ***E21B 33/12*** | (2006.01) |
| ***E21B 34/12*** | (2006.01) |
| ***E21B 43/119*** | (2006.01) |
| ***E21B 43/267*** | (2006.01) |
| ***E21B 47/06*** | (2012.01) |
| ***E21B 34/00*** | (2006.01) |

(52) U.S. Cl.
CPC ..... *E21B 43/14* (2013.01); *E21B 43/26* (2013.01); *E21B 43/267* (2013.01); *E21B 47/06* (2013.01); *E21B 2034/007* (2013.01)

(56) References Cited

U.S. PATENT DOCUMENTS

| | | | |
|---|---|---|---|
| 5,579,844 | A | 12/1996 | Rebardi et al. |
| 5,704,426 | A | 1/1998 | Rytlewski et al. |
| 5,829,520 | A | 11/1998 | Johnson |
| 6,543,538 | B2 | 4/2003 | Tolman et al. |
| 6,907,936 | B2 | 6/2005 | Fehr et al. |
| 6,957,701 | B2 | 10/2005 | Tolman et al. |
| 7,059,407 | B2 | 6/2006 | Tolman et al. |
| 7,168,494 | B2 | 1/2007 | Starr et al. |
| 7,353,879 | B2 | 4/2008 | Todd et al. |
| 7,477,160 | B2 | 1/2009 | Lemenager et al. |
| 7,516,792 | B2 | 4/2009 | Lonnes et al. |
| 7,575,062 | B2 | 8/2009 | East, Jr. |
| 7,735,559 | B2 | 6/2010 | Malone |
| 7,798,236 | B2 | 9/2010 | McKeachnie et al. |
| 8,167,047 | B2 | 5/2012 | Themig et al. |
| 8,215,411 | B2 | 7/2012 | Flores et al. |
| 8,220,542 | B2 | 7/2012 | Whitsitt et al. |
| 8,237,585 | B2 | 8/2012 | Zimmerman |
| 8,267,177 | B1 | 9/2012 | Vogel et al. |
| 8,276,670 | B2 | 10/2012 | Patel |
| 8,330,617 | B2 | 12/2012 | Chen et al. |
| 8,347,982 | B2 | 1/2013 | Hannegan et al. |
| 8,496,055 | B2 | 7/2013 | Mootoo et al. |
| 2002/0007949 | A1 | 1/2002 | Tolman et al. |
| 2004/0084190 | A1 | 5/2004 | Hill et al. |
| 2006/0118301 | A1 | 6/2006 | East, Jr. et al. |
| 2008/0093073 | A1 | 4/2008 | Bustos et al. |
| 2009/0032255 | A1 | 2/2009 | Surjaatmadja et al. |
| 2009/0101334 | A1 | 4/2009 | Baser et al. |
| 2010/0084134 | A1 | 4/2010 | Tulissi et al. |
| 2011/0048743 | A1 | 3/2011 | Stafford et al. |
| 2011/0168403 | A1 | 7/2011 | Patel |
| 2012/0043079 | A1 | 2/2012 | Wassouf et al. |
| 2012/0085548 | A1 | 4/2012 | Fleckenstein et al. |
| 2012/0090687 | A1 | 4/2012 | Grigsby et al. |
| 2012/0111566 | A1 | 5/2012 | Sherman et al. |
| 2012/0199349 | A1 | 8/2012 | Themig et al. |
| 2012/0292053 | A1 | 11/2012 | Xu et al. |
| 2013/0008648 | A1 | 1/2013 | Lovorn et al. |
| 2013/0105159 | A1 | 5/2013 | Alvarez et al. |
| 2013/0199790 | A1 | 8/2013 | Themig et al. |
| 2013/0206425 | A1 | 8/2013 | Mazyar et al. |
| 2013/0248174 | A1 | 9/2013 | Dale et al. |

* cited by examiner

SYSTEMS AND METHODS FOR STIMULATING A MULTI-ZONE SUBTERRANEAN FORMATION

CROSS-REFERENCE TO RELATED APPLICATIONS

This application is the National Stage of International Application No. PCT/US2013/070607, filed Nov. 18, 2013, which claims the benefit of U.S. Provisional Patent Application No. 61/745,144, filed Dec. 21, 2012, and U.S. Provisional Patent Application No. 61/835,331, filed Jun. 14, 2013, both are hereby incorporated by reference.

This application is also related to U.S. Provisional No. 61/745,136, and U.S. Provisional No. 61/745,140 both filed on Dec. 21, 2012; and U.S. Provisional No. 61/834,296, and U.S. Provisional No. 61/834,299, both filed on Jun. 12, 2013, and incorporated by reference.

FIELD OF THE DISCLOSURE

The present disclosure is directed generally to systems and methods for stimulating a subterranean formation, and more particularly to systems and methods that utilize a perforation device and an isolation sleeve to stimulate the subterranean formation.

BACKGROUND OF THE DISCLOSURE

A well may be utilized to produce one or more reservoir fluids, such as liquid and/or gaseous hydrocarbons, from a subterranean formation. The well may include a wellbore, which extends between a surface region and the subterranean formation, and a production casing that extends within the wellbore and defines a casing conduit.

During construction and/or operation of the well, it may be desirable to stimulate and/or fracture the subterranean formation, such as to increase a flow, or production, rate of reservoir fluids therefrom. In general, this stimulating includes providing a stimulating fluid to the casing conduit, with the stimulating fluid flowing from the casing conduit into the subterranean formation to thereby stimulate the subterranean formation. Illustrative examples of stimulation processes include fracturing the formation and acidizing, or acid treating, the formation. Typically, this stimulating process may be repeated a plurality of times along a length of the production casing to stimulate a plurality of zones of the subterranean formation.

A number of processes have been utilized to stimulate subterranean formations. While these processes may be effective under certain conditions, they may be ineffective under others. As an illustrative, non-exclusive example, a well may include a wellbore with a long horizontal section. This long horizontal section may extend within the subterranean formation, and it may be desirable to stimulate a plurality of zones of the subterranean formation that may be distributed along the length of the horizontal section.

Traditional stimulating processes may include establishing fluid communication between the casing conduit and a given zone of the subterranean formation, providing the stimulating fluid to the given zone of the subterranean formation to stimulate the given zone of the subterranean formation, and then fluidly isolating at least a portion of the casing conduit from the subterranean formation. This process may be repeated a plurality of times along a length of the horizontal section to stimulate the plurality of zones of the subterranean formation.

Generally, the traditional stimulating processes fluidly isolate the portion of the casing conduit from downhole portions of the casing conduit, and corresponding regions of the subterranean formation that are in fluid communication therewith, using isolation plugs or using isolation balls and seats. Isolation plugs may include and/or be expandable plugs that may be located within the casing conduit and subsequently expanded to fill a portion of the casing conduit, thereby blocking fluid flow therepast. Isolation balls may include and/or be elastomeric balls that are sized to fit within the casing conduit and to seal with a respective seat that is sized to receive the isolation ball to block the flow of fluid therepast.

However, as the length of the well is increased, setting the required number of isolation plugs becomes increasingly difficult and/or expensive and may inhibit economic and/or efficient stimulating of the subterranean formation. Moreover, the isolation plugs must be removed from the casing conduit, typically by time-consuming and/or expensive processes that include drilling the isolation plugs from the casing conduit, prior to production of the reservoir fluid from the subterranean formation.

Similarly, isolation balls and seats rely on progressively smaller balls and seats to stimulate a desired number of zones of the subterranean formation. Thus, there is a practical limit to the number of zones that may be stimulated with isolation balls and seats while still permitting sufficient fluid flow rates within the casing conduit. In addition, the progressively smaller seats effectively may limit access to portions of the casing conduit that are downhole therefrom, as many downhole assemblies simply may be too large to fit, or flow, through the seats. Furthermore, these seats often must be removed from the casing conduit prior to production of the reservoir fluid from the subterranean formation, and doing so increases the overall cost of the stimulation process. Thus, there exists a need for improved systems and methods for stimulating a subterranean formation.

SUMMARY OF THE DISCLOSURE

Systems and methods for stimulating a subterranean formation are disclosed herein. The methods include providing a stimulating fluid stream to a casing conduit, which is defined by a production casing that extends within the subterranean formation, to increase a fluid pressure within the casing conduit. The methods further include locating an isolation device on an isolation sleeve to fluidly isolate a downhole portion of the casing conduit from an uphole portion of the casing conduit and opening an injection port that is associated with the isolation sleeve to permit an injection port fluid flow from the casing conduit into the subterranean formation. The methods also include sealing the injection port and creating an uphole perforation in the uphole longitudinal section of the production casing responsive to the fluid pressure exceeding a threshold perforating pressure. The systems include a well that is formed, at least in part, utilizing the methods.

In some embodiments, the methods further include stimulating a zone of the subterranean formation. In some embodiments, the stimulating includes flowing the stimulating fluid stream through the injection port and/or through the uphole perforation. In some embodiments, the stimulating fluid stream is a fracturing fluid stream, and the stimulating includes fracturing the zone of the subterranean formation. In some embodiments, the methods further include providing a proppant to the stimulated zone of the subterranean formation. In some embodiments, and during the providing a proppant, the methods further include perforating the production casing responsive to the fluid pressure within the casing conduit exceeding a threshold screenout pressure. In some embodiments, the stimulating includes acidizing, or acid treating, the zone of the subterranean formation.

In some embodiments, the methods further include creating at least one downhole perforation, and thereby stimulating a zone of the subterranean formation associated with a downhole portion of the casing conduit, prior to locating the isolation device on the isolation sleeve. In some embodiments, the downhole perforation is created by a first perforation device, the uphole perforation is created by a second perforation device, and the methods further include flowing the second perforation device into the casing conduit while permitting the injection conduit fluid flow. In some embodiments, the methods further include receiving an injection port sealing device on an injection port sealing device seat that defines a portion of the injection conduit to seal the injection port.

In some embodiments, the methods include restricting and/or blocking fluid flow through a portion of the casing conduit with a fluid plug. In some embodiments, the methods include retaining the sealing device and/or the injection port sealing device on and/or near a perforation and/or an injection port sealing device seat, respectively, with the fluid plug.

The systems include wells that are formed, at least in part, by utilizing the methods. In some embodiments, the systems include casing conduits with flow control devices that include a seat for an isolation device and which are configured to selectively provide fluid communication with at least one, and optionally a plurality of, injection port(s). The injection ports are in fluid communication with the subterranean formation and are configured to receive sealing devices to obstruct fluid flow from the casing conduit therethrough to the subterranean formation.

DETAILED DESCRIPTION AND BEST MODE OF THE DISCLOSURE

Figure 1:
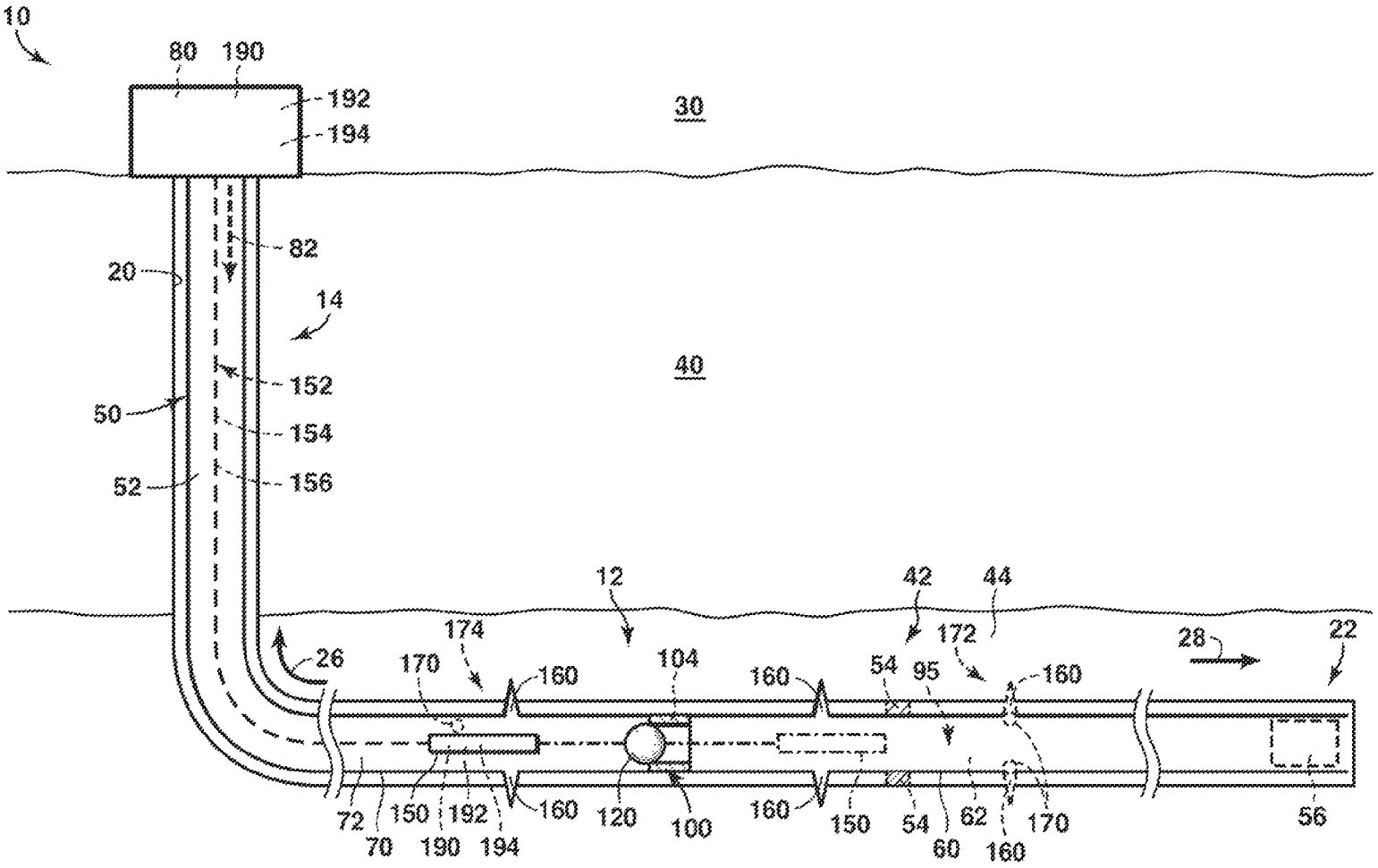
FIG. 1 is a schematic cross-sectional view of illustrative, non-exclusive examples of a well that may be utilized with and/or include the systems and methods according to the present disclosure.

FIGS. 1-13 provide illustrative, non-exclusive examples of wells 10 according to the present disclosure and/or of stimulation operations according to the present disclosure that may be performed within wells 10. Elements that serve a similar, or at least substantially similar, purpose are labeled with like numbers in each of FIGS. 1-13, and these elements may not be discussed in detail herein with reference to each of FIGS. 1-13. Similarly, all elements may not be labeled in each of FIGS. 1-13, but reference numerals associated therewith may be utilized herein for consistency. Elements, components, and/or features that are discussed herein with reference to one or more of FIGS. 1-13 may be included in and/or utilized with any of FIGS. 1-13 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a particular embodiment without departing from the scope of the present disclosure.

FIG. 1 is a schematic cross-sectional view of illustrative, non-exclusive examples of a well 10 that may be utilized with and/or include the systems and methods according to the present disclosure. FIGS. 2-9 provide more specific, but still illustrative, non-exclusive, examples of stimulation operations that may be performed within well 10 and/or that may include and/or utilize the systems and methods according to the present disclosure. FIGS. 10-13 provide illustrative, non-exclusive examples of an isolation sleeve 100 that includes an optional injection port 104 according to the present disclosure. When isolation sleeve 100 includes injection port 104, the isolation sleeve also may be referred to herein as a flow control assembly 100.

In FIGS. 1-9, well 10 includes a wellbore 20 that extends between a surface region 30 and a subterranean formation 42, with the subterranean formation being present within a subsurface region 40 (as illustrated in FIG. 1). Subterranean formation 42 may include a reservoir fluid 44. Reservoir fluid 44 additionally or alternatively may be referred to herein as, and/or may be, a hydrocarbon 44, a liquid hydrocarbon 44, and/or a gaseous hydrocarbon 44.

With continued reference to FIGS. 1-9, a production casing 50 extends within wellbore 20 and defines a casing conduit 52 therein. Well 10, wellbore 20, production casing 50, and/or casing conduit 52 may include a horizontal portion 12 and a vertical, deviated, and/or angled portion 14

(as illustrated in FIG. 1). Vertical portion 14 may extend (at least substantially) between surface region 30 and subterranean formation 42, while horizontal portion 12 may extend (at least substantially) within subterranean formation 42.

An isolation sleeve 100 is located within and/or defines a portion of production casing 50 defines a portion of casing conduit 52, and/or is located between a first section 60 of the production casing from a second section 70 of the production casing (and/or operatively attaches the first section of the production casing to the second section of the production casing). First section 60 also may be referred to herein as a first longitudinal section 60, as a downhole section 60, and/or as a downhole longitudinal section 60 of the production casing. Second section 70 also may be referred to herein as a second longitudinal section 70, as an uphole section 70, and/or as an uphole longitudinal section 70 of the production casing.

As illustrated in FIGS. 1 and 7-9, isolation sleeve 100 may be configured to receive an isolation device 120 thereon and/or otherwise in a sealing configuration in contact therewith. When present on isolation sleeve 100, isolation device 120 may be configured to fluidly isolate a first, or downhole, portion 62 of casing conduit 52 from a second, or uphole, portion 72 of the casing conduit. As discussed in more detail herein, isolation sleeve 100 further may be configured to selectively provide fluid communication between casing conduit 52 and subterranean formation 42 via an injection port 104 (and optionally a plurality of injection ports 104) that may be associated therewith (as illustrated in FIGS. 1, 8, and 10-13).

Figure 4:
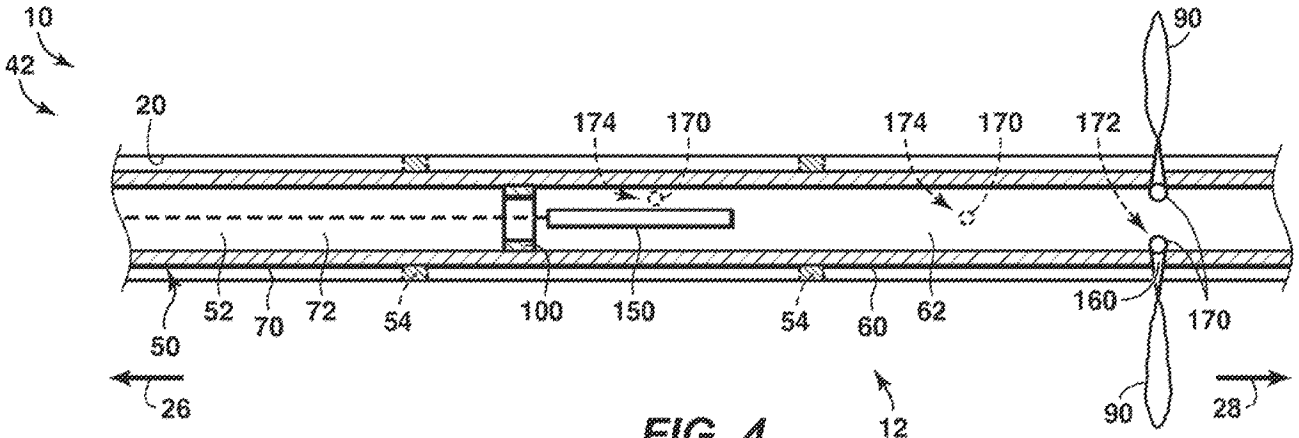
FIG. 4 provides an additional schematic cross-sectional view of the stimulation operations of FIG. 2.

Production casing 50 may include, or define, one or more perforations 160 therein. In addition, casing conduit 52 may contain one or more sealing devices 170, which may be configured to seal at least a portion of the one or more perforations 160. As an illustrative, non-exclusive example, and as indicated in FIGS. 1 and 4-9 at 172, sealing devices 170 may include and/or be seated sealing devices that may be located on a respective perforation 160 and limit (or even prevent) fluid flow through the respective perforation from the casing conduit into the subterranean formation. Additionally or alternatively, and as indicated in FIGS. 1 and 4 at 174, sealing devices 170 also may include and/or be free sealing devices that may not be located on a respective perforation 160, may not restrict or otherwise limit fluid flow through perforation 160, and/or may be free to move within casing conduit 52. As illustrated, sealing devices 170 may be sized to permit flow of the sealing devices past a perforation device 150 that is within casing conduit 52 (such as within an annular space that may be defined between the perforation device and production casing 50).

As indicated in dashed lines in FIG. 1, well 10 further may include (and/or casing conduit 52 may contain) an isolation plug 56. Isolation plug 56 may be located and/or configured to fluidly isolate an uphole portion of casing conduit 52 (such as a portion of the casing conduit that is located in an uphole direction 26 from the isolation plug) from a downhole portion of casing conduit 52 (such as a portion of the casing conduit that is located in a downhole direction 28 from the isolation plug). Additionally or alternatively, isolation plug 56 may be located at, or near, a terminal end 22 of production casing 50, casing conduit 52, and/or wellbore 20.

As also illustrated in dashed lines in FIG. 1, in some embodiments and/or according to some methods according to the present disclosure, well 10 further may include at least one optional fluid plug 95. Fluid plug 95 is formed from a gelled or otherwise thickened or stiffened fluid that inhibits fluid flow therethrough with the fluid plug being configured to dissolve or otherwise disperse after a given time period and/or responsive to exposure to a release agent. When present, fluid plug 95 may be configured to restrict and/or block fluid flow through a portion of casing conduit 52 that includes the fluid plug. Additionally or alternatively, fluid plug 95 also may be configured to retain sealing devices 170 on respective perforations 160 despite fluctuations in a pressure within the casing conduit. As illustrated in FIGS. 1-9, well 10 also may include one or more packers 54 that may be located within an annular space that is defined between production casing 50 and wellbore 20 and may be configured to limit fluid flow therepast.

Returning to FIG. 1, well 10 and/or perforation device 150 thereof further may include, be associated with, and/or be in communication with a controller 190 that may be programmed and/or configured to control the operation of at least a portion of the well. In addition, a detector 192 may be configured to detect a fluid pressure within casing conduit 52 and/or to provide the fluid pressure to controller 190.

As discussed in more detail herein, it may be desirable to stimulate subterranean formation 42, such as to increase a permeability thereof and/or to increase a production of reservoir fluid 44 therefrom. Thus, well 10 further may include and/or be in fluid communication with a stimulating fluid supply system 80 that is configured to provide a stimulating fluid stream 82 to casing conduit 52. As illustrative, non-exclusive examples, stimulating fluid stream 82 may include and/or be water, a proppant, an acid, a surfactant, and/or a foam. When well 10 includes stimulating fluid supply system 80, detector 192 may be configured to detect the fluid pressure of stimulating fluid stream 82 within the casing conduit and/or proximal to perforation device 150.

As illustrated in FIGS. 1-5 and 7-9, well 10 and/or casing conduit 52 thereof further may include and/or contain perforation device 150, which may be configured to create perforations 160 within production casing 50. Perforation device 150 may include any suitable structure. As an illustrative, non-exclusive example, perforation device 150 may include and/or be a perforation gun that includes one or more perforation charges. As an illustrative, non-exclusive example, perforation device 150 may include a plurality of perforation charges that are configured to create a respective plurality of perforations 160 within production casing 50. This may include at least three, at least four, at least six, at least eight, at least ten, at least twelve, at least fifteen, at least twenty, at least twenty-five, or at least thirty perforation charges. As discussed in more detail herein, the systems and methods according to the present disclosure may include creating perforations 160 in a plurality of sections of production casing 50, and a single perforation device 150 may be utilized (or re-used) at different times to create perforations 160 in at least a subset of the plurality of sections of the production casing. This may include creating perforations 160 in at least two, at least three, at least four, at least five, at least six, at least eight, or at least ten sections of the production casing.

As additional illustrative, non-exclusive examples, perforation device 150 may be operatively attached to a tether 152, such as a working line (or wireline) 154 and/or tubing 156. As another illustrative, non-exclusive example, perforation device 150 may include and/or be an autonomous perforation device 150, which is not tethered or otherwise physically and/or mechanically connected to surface region 30. Additionally or alternatively, perforation device 150 further may be actuated in any suitable manner. As illustrative, non-exclusive examples, perforation device 150 may be electrically actuated (such as via working line 154), may be hydraulically actuated, may be actuated remotely, and/or may be actuated autonomously.

It is within the scope of the present disclosure that perforation device 150 may be controlled and/or actuated in any suitable manner. As an illustrative, non-exclusive example, controller 190 and/or detector 192 may be associated with, included within, and/or operatively attached to perforation device 150 and may control the operation thereof. Additionally or alternatively, controller 190 and/or detector 192 may be located in, or proximal to, surface region 30 but may be in communication with the perforation device. It is within the scope of the present disclosure that controller 190 may control the operation of well 10 and/or perforation device 150 in any suitable manner, such as through the use of methods 200, which are discussed in more detail herein.

As another illustrative, non-exclusive example, perforation device 150 may include and/or be in communication with a perforation device control structure 194 that is configured to control the operation thereof. This may include any suitable active and/or actively controlled perforation device control structure, as well as any suitable passive and/or passively controlled perforation device control structure. As an illustrative, non-exclusive example, perforation device control structure 194 may be programmed, selected, and/or configured to automatically actuate perforation device 150 responsive to the fluid pressure within casing conduit 52 exceeding a threshold perforating pressure and/or a threshold screenout pressure.

Fluid plug 95, when present, may include any suitable structure that may limit, block, restrict, and/or occlude fluid flow therepast and/or that may retain balls sealers 170 on respective perforations 160. As an illustrative, non-exclusive example, fluid plug 95 may be formed from a sealing fluid that may be provided to casing conduit 52 from surface region 30. As an illustrative, non-exclusive example, the sealing fluid may include and/or be a crosslinking solution, such as a crosslinking polymer solution, a crosslinking gel solution, and/or a borate gel solution, that may be selected to crosslink within the casing conduit.

As another illustrative, non-exclusive example, and as discussed, fluid plug 95 may be selected to retain sealing devices 170 on perforations 160 despite fluctuations in pressure within casing conduit 52 and/or despite fluctuations in a pressure differential across sealing devices 170 between casing conduit 52 and subterranean formation 42. As an illustrative, non-exclusive example, fluid plug 95 may be selected to retain the sealing devices on the perforations even when the pressure differential would be insufficient to retain the sealing devices on the perforations without the presence of the fluid plug. As another illustrative, non-exclusive example, fluid plug 95 may be selected to retain the sealing devices on the perforations during removal of a downhole assembly, such as perforation device 150, from the casing conduit.

As yet another illustrative, non-exclusive example, the systems and methods according to the present disclosure may include locating and/or forming fluid plug 95 within casing conduit 52 responsive to a malfunction of one or more components of well 10, such as but not limited to perforation device 150, isolation sleeve 100, etc. Additional illustrative, non-exclusive examples of fluid plugs that may be utilized with and/or included in the systems and methods according to the present disclosure are disclosed in U.S. Provisional Application No. 61/834,299, which was filed on Jun. 12, 2013, and the complete disclosure of which is hereby incorporated by reference.

As discussed in more detail herein, perforation device 150, isolation device 120, and/or sealing devices 170 may be selected to be mobile and/or to be selectively located and/or present within casing conduit 52. As an illustrative, non-exclusive example, and as illustrated in dash-dot lines in FIG. 1 and solid lines in FIGS. 2-5, perforation device 150 may be located downhole from isolation sleeve 100 and/or may be configured to create perforations 160 within downhole section 60 of production casing 50. Thus, perforation device 150 and/or isolation sleeve 100 may be sized to permit perforation device 150 to be conveyed past the isolation sleeve within casing conduit 52.

Figure 7:
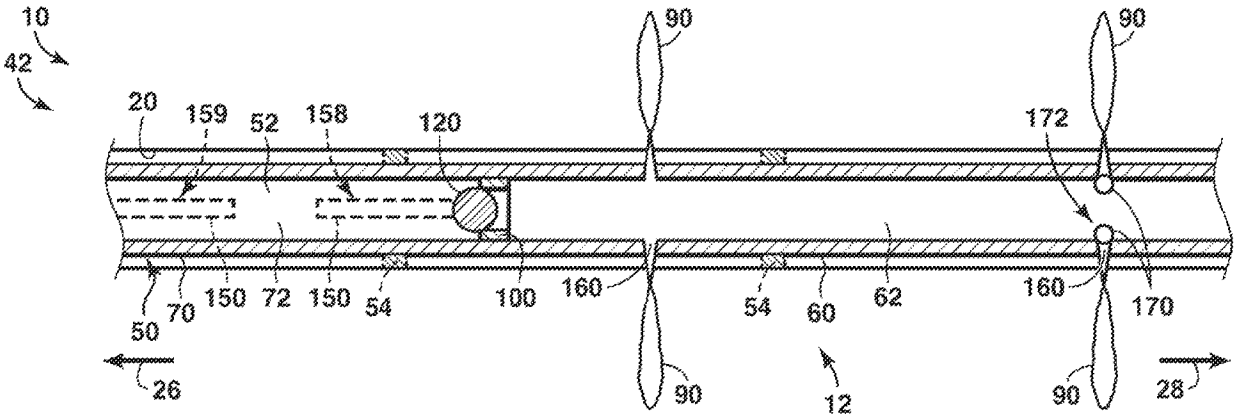
FIG. 7 provides an additional schematic cross-sectional view of the stimulation operations of FIG. 2.
Figure 8:
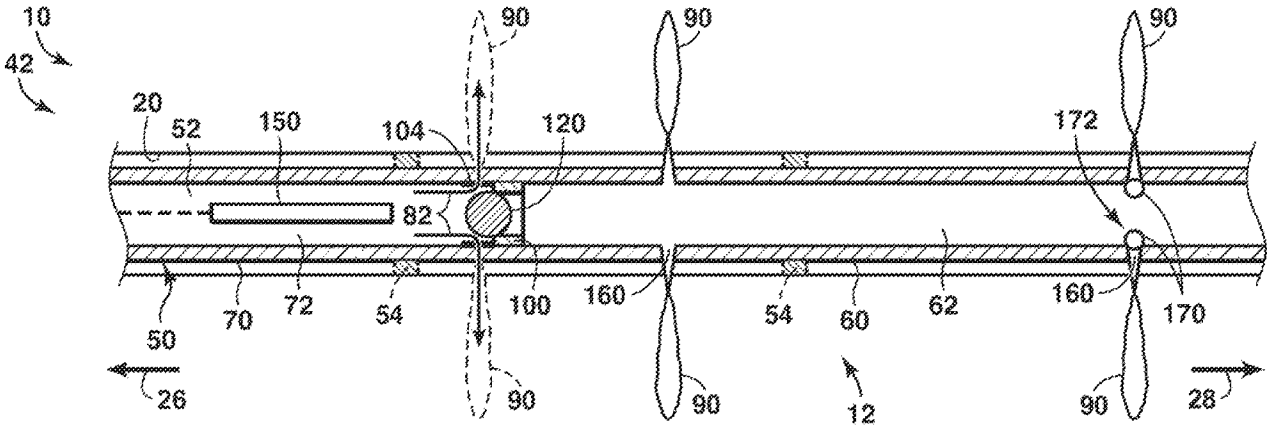
FIG. 8 provides an additional schematic cross-sectional view of the stimulation operations of FIG. 2.
Figure 9:
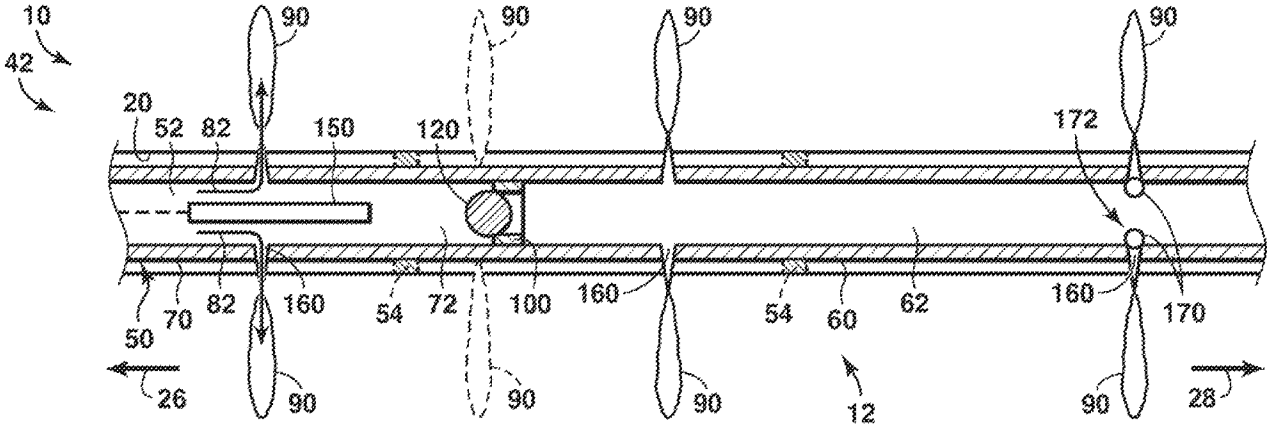
FIG. 9 provides an additional schematic cross-sectional view of the stimulation operations of FIG. 2.

As another illustrative, non-exclusive example, and as illustrated in solid lines in FIGS. 1 and 8-9 and in dashed lines in FIG. 7, perforation device 150 may be located uphole from isolation sleeve 100 and/or may be configured to create perforations 160 within uphole section 70 of production casing 50. It is within the scope of the present disclosure that the same perforation device 150 may be utilized to form perforations within downhole section 60 and uphole section 70 of production casing 50. However, it is also within the scope of the present disclosure that, as discussed herein, a first perforation device 150 may be utilized to create perforations in downhole section 60 and that a second perforation device 150 may be utilized to create perforations in uphole section 70 of production casing 50.

As discussed herein and illustrated in FIG. 1, well 10 may include a horizontal (or at least substantially horizontal) portion 12 and a vertical (or at least substantially vertical) portion 14, and downhole section 60 and/or uphole section 70 of production casing 50 may be located within (or at least substantially within) horizontal portion 12. It is within the scope of the present disclosure that wellbore 20, production casing 50, and/or casing conduit 52 may define any suitable length, which also may be referred to herein as a longitudinal length. As illustrative, non-exclusive examples, the length may be at least 1000 meters (m), at least 1500 m, at least 2000 m, at least 2500 m, at least 3000 m, at least 3500 m, at least 4000 m, at least 4500 m, or at least 5000 m. Additionally or alternatively, it is also within the scope of the present disclosure that a distance along production casing 50 between the surface region and first portion 60 and/or second portion 70 may define any suitable proportion of the length of the production casing. As illustrative, non-exclusive examples, the distance may be at least 25%, at least 30%, at least 35%, at least 40%, at least 45%, at least 50%, at least 55%, at least 60%, at least 65%, at least 70%, at least 75%, at least 80%, at least 85%, at least 90%, at least 95%, or at least 99% of a/the length of the production casing.

As discussed in more detail herein, it may be desirable to stimulate and/or fracture a plurality of zones of a subterranean formation. In addition, and as a length of a well is increased, a number of zones to be stimulated may increase (or may increase proportionate to the length of the well). In general, fracturing, acidizing, and/or other stimulation of the subterranean formation may be accomplished more efficiently by selectively providing fluid communication between the casing conduit and a given zone of the subterranean formation. This may include establishing the fluid communication, stimulating, the given zone of the subterranean formation (such as by providing a stimulating fluid stream from the casing conduit into the given zone of the subterranean formation), and subsequently fluidly isolating the given zone of the subterranean formation from the casing conduit. This process may be repeated a plurality of times to stimulate and/or fracture a desired number of zones of the subterranean formation. Thus, the casing conduit may be fluidly isolated from the subterranean formation a plurality of times during an overall stimulation process and/or during stimulation of the desired number of zones of the subterranean formation.

As also discussed, traditional stimulating processes may fluidly isolate a portion of the casing conduit from the subterranean formation using isolation plugs and/or using isolation balls and seats. Each of these traditional approaches suffers from inherent limitations associated with the use thereof in extended reach wells that may include long wellbores. Additionally or alternatively, each of these traditional approaches also suffers from inherent inefficiencies that may be associated with the use thereof and/or that may increase a cost associated with use thereof.

As an illustrative, non-exclusive example, and while isolation plugs may be effective at fluidly isolating an uphole portion of a casing conduit from a downhole portion of a casing conduit, it may be necessary to remove a perforation device (or other downhole assembly) that may be present within the casing conduit from the casing conduit prior to insertion and/or use of the isolation plugs within the casing conduit, significantly increasing an overall time and/or cost associated with the stimulation process. Often, this removal of the perforation device and insertion of the isolation plug must be repeated for each zone of the subterranean formation that is to be stimulated, thus generating a casing conduit that includes a plurality of isolation plugs located therein.

As another illustrative, non-exclusive example, and subsequent to stimulation of the desired number of zones of the subterranean formation, the plurality of isolation plugs often must be removed from the casing conduit prior to producing a reservoir fluid from the subterranean formation. As an illustrative, non-exclusive example, a drill rig may need to be utilized to drill the plurality of isolation plugs from the casing conduit. Once again, this increases the cost and/or time required to complete the stimulation operation.

As yet another illustrative, non-exclusive example, and while isolation balls and seats also may be effective at fluidly isolating the uphole portion of the casing conduit from the downhole portion of the casing conduit, it may be necessary to utilize one isolation ball and seat for each zone of the subterranean formation that is to be stimulated and/or to utilize a large number of isolation balls and seats during the stimulation process. Isolation balls and seats rely upon progressively smaller seats that may be sealed by progressively smaller balls. As such, a given seat may be sized to permit isolation balls that are associated with seats that are located downhole therefrom to flow therethrough while, at the same time, forming a fluid seal with an isolation ball that is sized to seal therewith. Thus, there are practical limitations on a total number of isolation balls and seats that may be utilized for a given diameter of the production casing.

The small size of many of the seats may preclude access to portions of the casing conduit that may be downhole therefrom by a downhole assembly, such as a drill string and/or a perforation gun, thereby complicating wellbore drilling and/or completion processes. In addition, and similar to the isolation plugs, the seats often must be removed from the casing conduit, such as by drilling, prior to production of the reservoir fluid from the subterranean formation. Once again, this increases the overall time and/or cost associated with the stimulation operation.

With this in mind, FIGS. 2-9 are schematic cross-sectional views of illustrative, non-exclusive examples of stimulation operations and/or process flows that may include and/or utilize the systems and methods according to the present disclosure. The stimulation operations of FIGS. 2-9 may permit stimulation of long and/or extended reach wells without the need to locate a plurality of isolation plugs (such as, but not limited to, bridge plugs) within the casing conduit and/or without the need to utilize an isolation ball and seat for each stimulated zone of the subterranean formation. Additionally or alternatively, the stimulation operations of FIGS. 2-9 also may permit stimulation of the wells without the need to remove and/or drill the isolation plugs and/or the seats from the casing conduit subsequent to completion of the stimulation operation.

Figure 2:
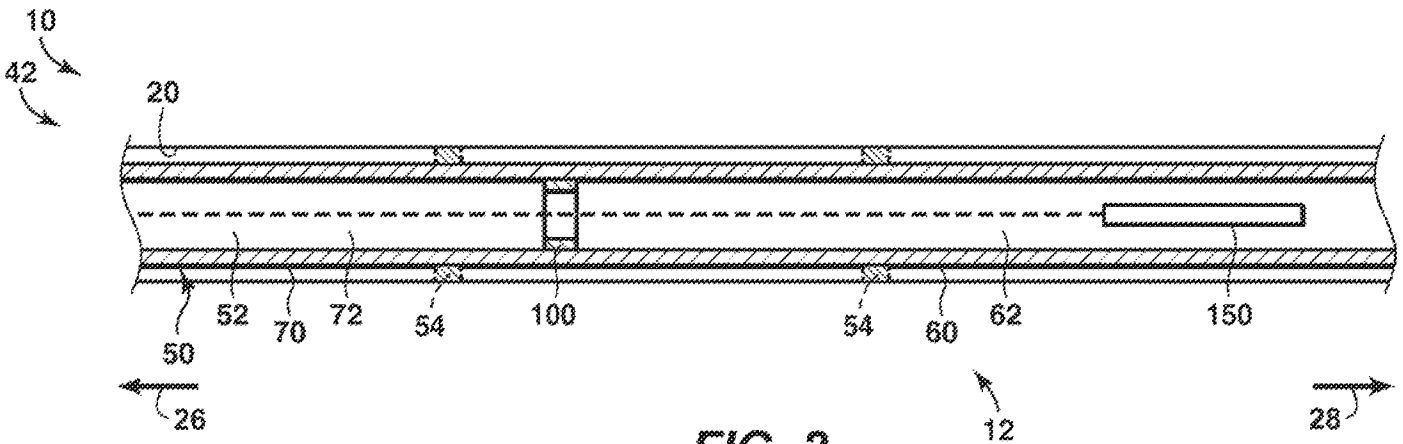
FIG. 2 provides a schematic cross-sectional view of illustrative, non-exclusive examples of stimulation operations that may include and/or utilize the systems and methods according to the present disclosure.
Figure 3:
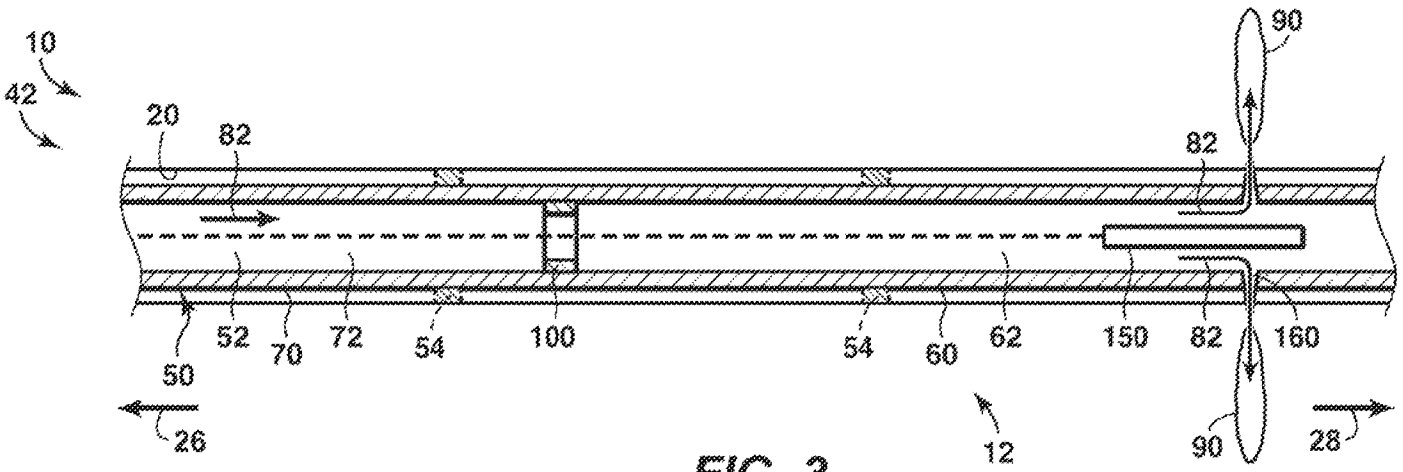
FIG. 3 provides an additional schematic cross-sectional view of the stimulation operations of FIG. 2.

In FIG. 2, perforation device 150 has been located within casing conduit 52 and downhole from isolation sleeve 100 (i.e., within downhole portion 62 of casing conduit 52 that is defined by downhole section 60 of production casing 50). Subsequently, and as illustrated in FIG. 3, perforation device 150 may be utilized to create, form, and/or generate one or more perforations 160 within downhole section 60 of production casing 50.

As discussed in more detail herein, and prior to creation of perforations 160 within downhole section 60, stimulating fluid 82 may be provided to casing conduit 52 to increase the fluid pressure therein, and perforations 160 may be created responsive to the fluid pressure exceeding a threshold perforating pressure. Thus, subsequent to creation of perforations 160, stimulating fluid 82 may flow through perforations 160 into subterranean formation 42 to create one or more fractures 90 therein.

Figure 5:
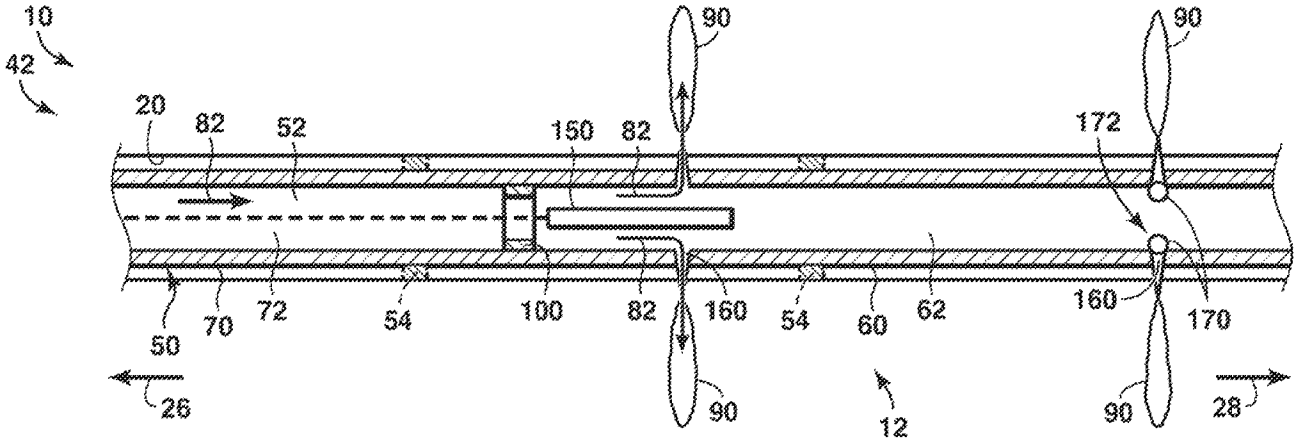
FIG. 5 provides an additional schematic cross-sectional view of the stimulation operations of FIG. 2.

After creation of fractures 90, and as illustrated in FIG. 4, one or more sealing devices 170 may be located on perforations 160. This may include flowing and/or otherwise conveying sealing devices 170 past perforation device 150 within casing conduit 52 and/or through the annular space that is defined between perforation device 150 and production casing 50, as discussed herein. In addition, perforation device 150 may be moved and/or translated in uphole direction 26 within the casing conduit. Subsequently, and as illustrated in FIG. 5, perforation device 150 may be utilized to create one or more additional perforations 160 within production casing 50 and stimulating fluid 82 may be provided to subterranean formation 42 through perforations 160 to create one or more additional fractures 90 within the subterranean formation. This may include providing the stimulating fluid to the casing conduit prior to formation of perforations 160 and/or creating perforations 160 responsive to the fluid pressure within the casing conduit exceeding the threshold perforating pressure, as discussed herein.

Figure 6:
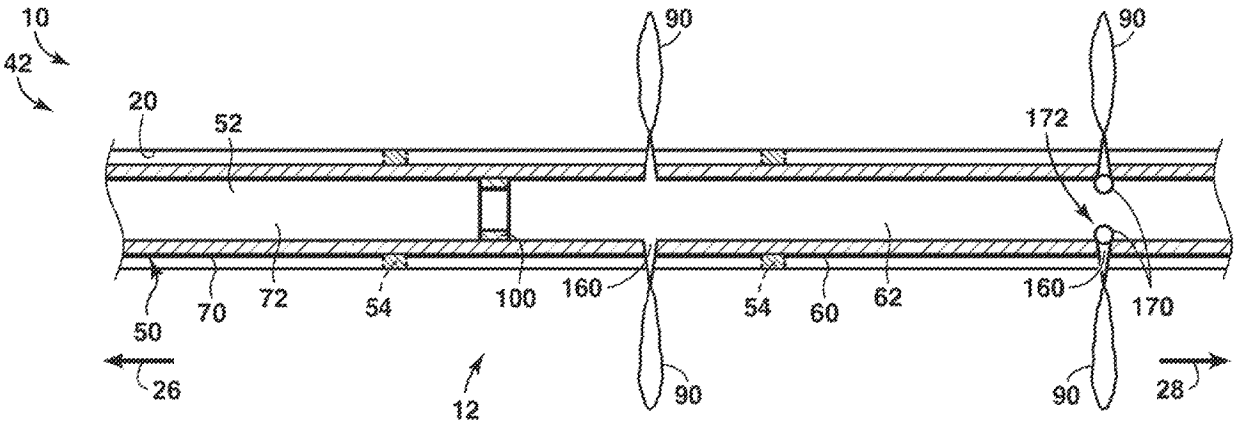
FIG. 6 provides an additional schematic cross-sectional view of the stimulation operations of FIG. 2.

After creation of fractures 90, and as illustrated in FIG. 6, perforation device 150, which also may be referred to herein as and/or may be a first perforation device 150, may be removed from casing conduit 52. Then, and as illustrated in FIG. 7, an isolation device 120 may be located on isolation sleeve 100 to fluidly isolate downhole portion 62 of casing conduit 52 from uphole portion 72 of the casing conduit. This may include flowing the isolation device within casing conduit 52, from surface region 30 (as illustrated in FIG. 1), and/or into contact with isolation sleeve 100.

As illustrated in dashed lines in FIG. 7, the stimulation operation further may include flowing perforation device 150, which also may be referred to herein as and/or may be a second perforation device 150, into casing conduit 52 at least partially concurrently with locating isolation device 120 on isolation sleeve 100. As an illustrative, non-exclusive example, and as illustrated in FIG. 7 at 158, second perforation device 150 may be operatively attached to and/or may form a portion of isolation device 120.

As another illustrative, non-exclusive example, and as illustrated in FIG. 7 at 159, second perforation device 150 may be separate and/or distinct from isolation device 120. When second perforation device 150 is separate from isolation device 120, the stimulation operation additionally or alternatively may include tractoring the perforation device into the casing conduit, with the tractoring being performed at least partially concurrently with and/or after flowing the isolation device through the casing conduit and/or locating the isolation device on the isolation sleeve.

Additionally or alternatively, and as illustrated in FIG. 8, isolation sleeve 100 may be configured to selectively provide fluid communication between casing conduit 52 and subterranean formation 42 via at least one injection port 104, and this fluid communication may be initiated responsive to isolation device 120 being received on isolation sleeve 100 and/or responsive to at least a threshold pressure drop (or differential) being established across isolation device 120 after isolation device 120 has been received on, or otherwise engaged in a sealing configuration with, isolation sleeve 100. Injection port 104 may permit an injection conduit fluid flow of stimulating fluid 82 from casing conduit 52 into subterranean formation 42, thereby permitting perforation device 150 to be flowed through the casing conduit subsequent to the isolation device being located on the isolation sleeve and/or subsequent to the isolation device fluidly isolating downhole portion 62 of casing conduit 52 from uphole portion 72 of the casing conduit. In addition, injection port 104 may be sized to maintain at least a threshold pressure drop thereacross when the injection conduit fluid flow is flowing therethrough. This threshold pressure drop may be selected to (or to be sufficient to) retain sealing devices 170 that may be uphole from isolation sleeve 100 on respective perforations 160 that may be associated therewith and/or to retain isolation device 120 on isolation sleeve 100.

Additionally or alternatively, and as illustrated in dashed lines in FIG. 8, the injection conduit fluid flow also may create one or more additional fractures 90 within the subterranean formation. When isolation sleeve 100 includes injection port 104, and as discussed in more detail herein, the injection port subsequently may be sealed to restrict fluid flow therethrough, such as through the use of a sealing device. Illustrative, non-exclusive examples of isolation sleeves 100 that also may include and/or define injection ports 104 are disclosed in U.S. Provisional Application No. 61/834,296, which was filed on Jun. 12, 2013, and the complete disclosure of which is hereby incorporated by reference.

Subsequently, and as illustrated in FIG. 9, perforation device 150 may be utilized to create one or more additional perforations 160 within production casing 50, and stimulating fluid 82 may be provided to subterranean formation 42 through perforations 160 to create one or more additional fractures 90 within the subterranean formation. This may include providing the stimulating fluid to the casing conduit prior to formation of perforations 160 and/or creating perforations 160 responsive to the fluid pressure within the casing conduit exceeding the threshold perforating pressure, as discussed herein.

FIGS. 10-13 provide less schematic but still illustrative, non-exclusive examples of an optional flow control assembly 100 (or isolation sleeve 100) according to the present disclosure that may form a portion of a production casing 50 and/or of a well 10. Flow control assembly 100 may include any suitable structure that may form a portion of production casing 50, that may be configured to selectively control a fluid flow (such as in uphole direction 26 and/or downhole direction 28) within casing conduit 52, and/or that may be configured to selectively control a fluid flow between casing conduit 52 and subterranean formation 42.

The flow control assemblies 100 of FIGS. 10-13 may include a housing 110 that includes a housing body 112. Housing body 112 defines an inner surface 126 of housing 110, which defines a housing conduit 320 that forms a portion of casing conduit 52. The housing body also defines an outer surface 128 of housing 110, which may be opposed to inner surface 126 and/or may be proximal to and/or in direct fluid communication with subterranean formation 42 (when the flow control assembly is present within the subterranean formation). When flow control assembly 100 is located within production casing 50, housing body 112 may be referred to herein as defining a portion of the production casing, as being operatively attached to the production casing, and/or as being located within the production casing.

Housing body 112 also defines an injection port 104 that defines an injection conduit 114 that extends through the housing body between inner surface 126 and outer surface 128. Thus, when flow control assembly 100 is present within subterranean formation 42, injection conduit 114 extends and/or provides fluid communication between housing conduit 320 and/or casing conduit 52 and subterranean formation 42.

Figure 12:
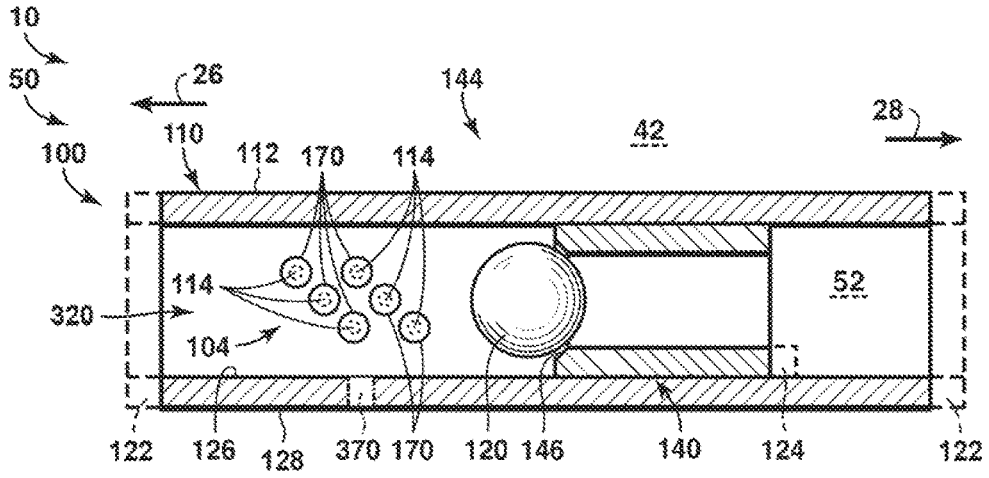
FIG. 12 is another less schematic representation of illustrative, non-exclusive examples of an optional flow control assembly according to the present disclosure in the second configuration.

Housing 110 and/or housing body 112 thereof further include and/or define a sealing device seat 116. Sealing device seat 116 defines a portion of injection conduit 114 and may be defined on, near, and/or by inner surface 126 of housing 110. Sealing device seat 116 may be formed with the housing body or separately formed and then secured to the housing body. Sealing device seat 116 is sized to receive a sealing device 170 (as illustrated in FIG. 12). When present on sealing device seat 116, sealing device 170 restricts fluid flow from casing conduit 52 through injection conduit 114. Illustrative, non-exclusive examples of sealing device seats 116 are discussed in more detail herein with reference to FIG. 13.

Figure 10:
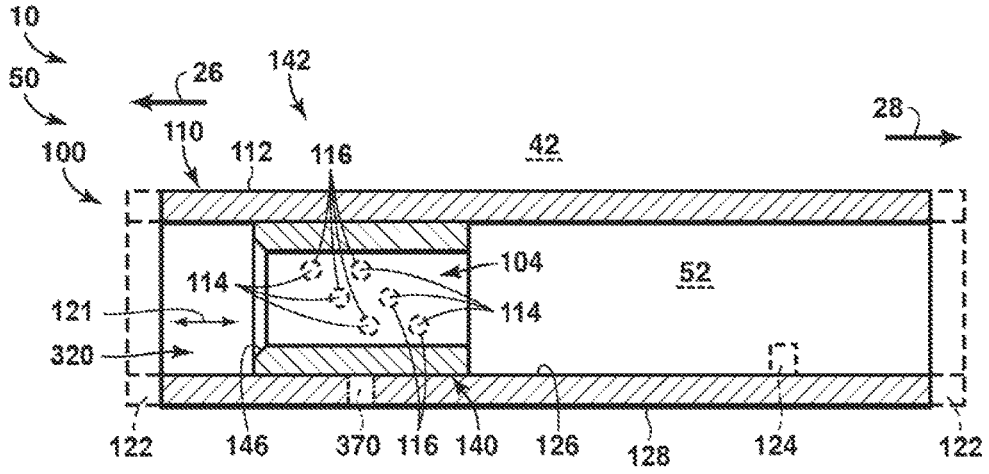
FIG. 10 is a less schematic representation of illustrative, non-exclusive examples of an optional flow control assembly according to the present disclosure in a first configuration.
Figure 11:
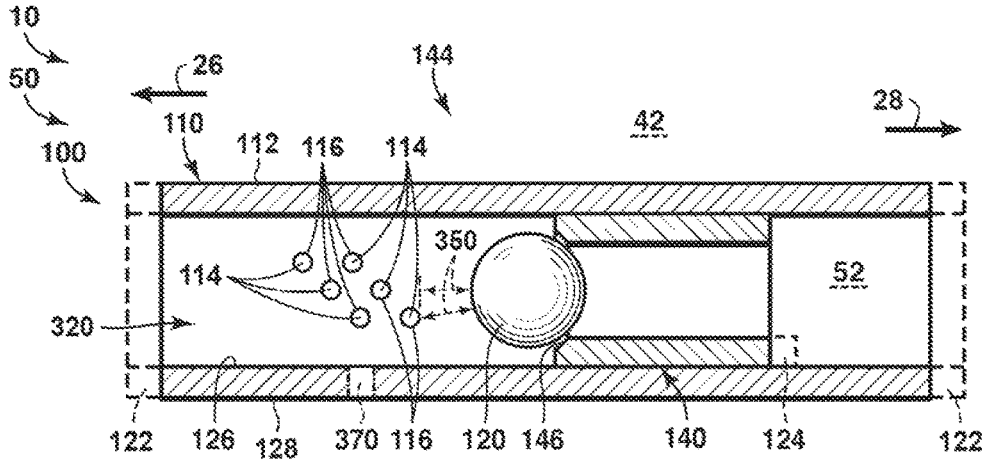
FIG. 11 is a less schematic representation of illustrative, non-exclusive examples of an optional flow control assembly according to the present disclosure in a second configuration.

Flow control assembly 100 further includes a sliding sleeve 140 that is located within housing conduit 320. Sliding sleeve 140 is configured to selectively transition between a first configuration 142, as illustrated in FIG. 10, and a second configuration 144, as illustrated in FIGS. 11-12. When sliding sleeve 140 is in first configuration 142, the sliding sleeve resists, blocks, occludes, and/or stops a fluid flow through the injection conduit. Although not required, this fluid flow may be referred to herein as an injection conduit fluid flow. Conversely, when sliding sleeve 140 is in second configuration 144, the sliding sleeve permits, facilitates, allows, and/or provides for the fluid flow through the injection conduit.

Sliding sleeve 140 further includes and/or defines an isolation device seat 146 that is sized and/or configured to receive an isolation device 120. When isolation device 120 is not present on isolation device seat 146, flow control assembly 100 permits a fluid flow within housing conduit 320, such as a flow in uphole direction 26 and/or in downhole direction 28. Conversely, and when isolation device 120 is present on isolation device seat 146, flow control assembly 100 restricts, blocks, occludes, and/or stops a fluid flow within housing conduit 320 in downhole direction 28 past the isolation device.

Flow control assembly 100 also includes a retention structure 370. Retention structure 370 is configured to retain sliding sleeve 140 in the first configuration and to selectively permit the sliding sleeve to transition to the second configuration when isolation device 120 is received by (and/or otherwise contacts or engages) sliding sleeve 140, when isolation device 120 is received by (and/or otherwise contacts or engages) isolation device seat 146, and/or when isolation device 120 is located on isolation device seat 146 and a pressure differential across the isolation device is greater than a threshold pressure differential. As an illustrative, non-exclusive example, retention structure 370 may include and/or be at least one shear pin that is configured to retain the sliding sleeve in the first configuration and to permit the sliding sleeve to transition from the first configuration to the second configuration upon, responsive to, or as a result of, shearing of the shear pin.

It is within the scope of the present disclosure that retention structure 370 (optionally) also may be configured to retain sliding sleeve 140 in the second configuration. As such, the sliding sleeve may be configured to be retained in the second configuration subsequent to transitioning thereto.

Flow control assembly 100 also may include and/or be associated with one or more attachment structures 122 and/or a sleeve stop 124. Attachment structures 122 may include any suitable structure that may be configured and/or designed to operatively attach flow control assembly 100 to a remainder of production casing 50. Sleeve stop 124 may include any suitable structure that is configured to limit a motion of sliding sleeve 140 when the sliding sleeve transitions between the first configuration and the second configured, from the first configuration to the second configuration, and/or from the second configuration to the first configuration.

In FIG. 10, flow control assembly 100 is in first configuration 142, in which the flow control assembly resists a fluid flow (or an injection conduit fluid flow) through injection conduits 114. However, the flow control assembly permits a housing conduit fluid flow 121 through housing conduit 320.

In FIG. 11, an isolation device 120 is located on isolation device seat 146 of sliding sleeve 140 and flow control assembly 100 (or sliding sleeve 140 thereof) has transitioned to a second configuration 144, wherein the flow control assembly permits the fluid flow (or the injection conduit fluid flow) through injection conduits 114. However, the isolation device resists, or prevents, the housing conduit fluid flow in downhole direction 28 through housing conduit 320.

FIG. 11 also illustrates that flow control assembly 100 may define a minimum clearance 350, which may be defined as a minimum distance between sealing device seats 116 (or sealing devices 170, when present thereon) and isolation device 120 and/or as a distance between sealing device seats 116 (or sealing devices 170, when present thereon) and isolation device 120 as measured along a longitudinal axis of flow control assembly 100. It is within the scope of the present disclosure that minimum clearance 350 may include and/or be any suitable value. As an illustrative, non-exclusive example, minimum clearance 350 may be greater than an outer radius (or greater than half an outer diameter) of sealing device 170. As additional illustrative, non-exclusive examples, minimum clearance 350 may be at least 0.6 times, at least 0.7 times, at least 0.8 times, at least 0.9 times, at least 1 time, at least 1.1 times, at least 1.2 times, at least 1.3 times, at least 1.4 times, at least 1.5 times, at least 1.6 times, at least 1.7 times, at least 1.8 times, at least 1.9 times, or at least 2 times greater than the outer diameter (or other characteristic dimension) of the sealing device. Additionally or alternatively, minimum clearance 350 also may be less than 5 times, less than 4.75 times, less than 4.5 times, less than 4 times, less than 3.75 times, less than 3.5 times, less than 3.25 times, less than 3 times, less than 2.75 times, less than 2.5 times, less than 2.25 times, less than 2 times, less than 1.75 times, or less than 1.5 times greater than the outer diameter (or other characteristic dimension) of the sealing device.

In FIG. 12, the flow control assembly is in second configuration 144, and isolation device 120 is located on isolation device seat 146 and resists the housing conduit fluid flow in downhole direction 28 through housing conduit 320. In addition, sealing devices 170 are located on sealing device seats 116 and resist the fluid flow (or the injection conduit fluid flow) through injection conduits 114.

Figure 13:
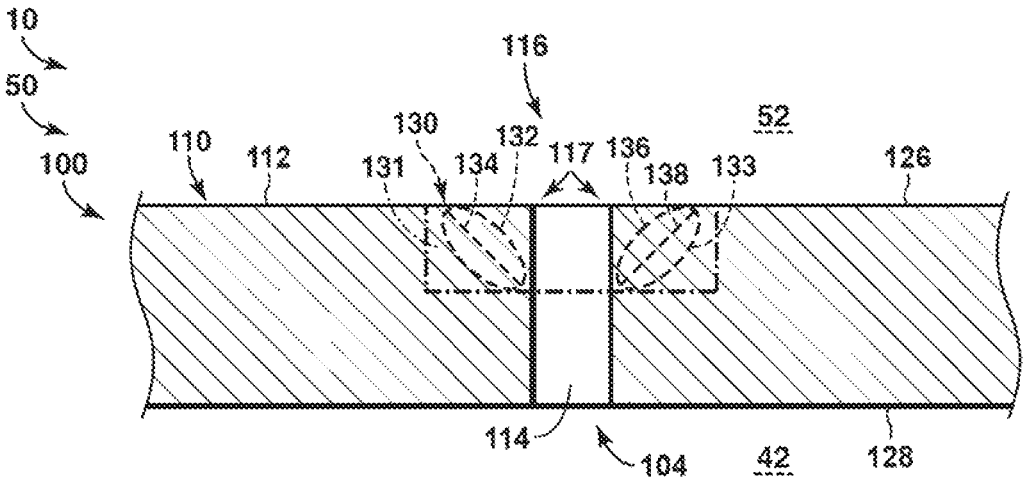
FIG. 13 is a schematic representation of illustrative, non-exclusive examples of a portion of a housing body that includes and/or defines a sealing device seat and may form a portion of an optional flow control assembly according to the present disclosure.

FIG. 13 is a schematic representation of illustrative, non-exclusive examples of a portion of a housing 110 that includes and/or defines a sealing device seat 116 and may form a portion of a flow control assembly 100 according to the present disclosure. Sealing device seats 116 according to the present disclosure may be specifically configured, designed, machined, sized, and/or selected to form a fluid seal with a sealing device, when present thereon. As such, a size, shape, and/or material of construction of the sealing device seat may be selected to permit, encourage, and/or facilitate effective sealing by the sealing device.

As an illustrative, non-exclusive example, sealing device seats 116 may include and/or define a sealing device sealing surface 117 that is specifically configured to form the fluid seal. In contrast to a portion of production casing 50 that may define perforations 160 (as illustrated in FIGS. 1-9), sealing device sealing surface 117 may include and/or be a smooth surface and/or a regular surface. As an illustrative, non-exclusive example, the sealing device sealing surface may include and/or be a circular, or at least substantially circular, sealing device sealing perimeter, edge, surface, or surface region. As additional illustrative, non-exclusive examples, sealing device sealing surface 117 may include a rounded edge (or edge region) 132, a chamfered, or tapered, edge 134 (or edge region), and/or an edge (or edge region) 133 that is shaped to conform to the shape of the portion of a sealing device that engages the edge.

It is within the scope of the present disclosure that sealing device seat 116 may be defined by and/or formed from the same material as housing body 112. Alternatively, it is also within the scope of the present disclosure that sealing device seat 116 may be defined by and/or formed from a material that is different from, or has a different material composition than, that of housing body 112. As illustrative, non-exclusive examples, sealing device seat 116 may include and/or be defined by a coating 136 that is operatively attached to housing body 112, a surface treatment 138 of housing body 112, and/or an insert 130 that is operatively attached to housing body 112 and is defined by an insert material 131 that may be different from a material that defines housing body 112.

Additionally or alternatively, it is also within the scope of the present disclosure that sealing device seat 116 (and/or a material of construction thereof) may be selected to improve formation of the fluid seal with the sealing device and/or to resist damage during flow of fluid, granular materials, and/or proppant therethrough. As illustrative, non-exclusive examples, the sealing device seat may include and/or be an erosion-resistant sealing device seat, a corrosion-resistant sealing device seat, a hardened sealing device seat, a resilient sealing device seat, an elastomeric sealing device seat, and/or a compliant sealing device seat. Accordingly, the sealing device seat may be constructed of, be coated with, be lined with, and/or include (i) a material and/or composition (including, but not limited to, a carbide seat or a carbide insert or engagement surface for a seat that is formed from a different composition, such as the same composition as the housing body) that is harder and/or more resistant to abrasion than the material from which housing body 112 is formed, (ii) a material that is less reactive and/or more resistant to corrosion (in wellbore environments) than the material from which housing body 112 is formed, and/or (iii) a material that is softer and/or more resilient, and/or compressible, and/or compliant than the material from which housing body 112 is formed.

It is within the scope of the present disclosure that sealing device sealing surface 117 may define any suitable diameter, or inner diameter. As illustrative, non-exclusive examples, the inner diameter of the sealing device sealing surface may be at least 0.5 centimeters (cm), at least 0.6 cm, at least 0.7 cm, at least 0.8 cm, at least 0.9 cm, at least 1 cm, or at least 1.1 cm. Additionally or alternatively, the inner diameter of the sealing device sealing surface also may be less than 1.5 cm, less than 1.4 cm, less than 1.3 cm, less than 1.2 cm, less than 1.1 cm, or less than 1 cm.

It is also within the scope of the present disclosure that the inner diameter of the sealing device sealing surface may be selected relative to an outer diameter of a sealing device that is configured to form the fluid seal therewith. As illustrative, non-exclusive examples, the inner diameter of the sealing device sealing surface may be at least 25%, at least 65%, at least 70%, or at least 75% of an outer diameter of the sealing device. Additionally or alternatively, the inner diameter of the sealing device sealing surface also may be less than 95%, less than 90%, less than 85%, less than 80%, less than 75%, less than 70%, less than 65%, less than 60%, less than 55%, less than 50%, less than 45%, or less than 40% of the outer diameter of the sealing device.

Illustrative, non-exclusive examples of outer diameters of sealing devices 170 that may be utilized with the systems and methods according to the present disclosure include outer diameters of at least 1 cm, at least 1.1 cm, at least 1.2 cm, at least 1.3 cm, at least 1.4 cm, at least 1.5 cm, at least 1.6 cm, at least 1.7 cm, at least 1.8 cm, at least 1.9 cm, or at least 2 cm. Additionally or alternatively, the outer diameter of the sealing devices also may be less than 3 cm, less than 2.9 cm, less than 2.8 cm, less than 2.7 cm, less than 2.6 cm, less than 2.5 cm, less than 2.4 cm, less than 2.3 cm, less than 2.2 cm, less than 2.1 cm, or less than 2 cm.

It is further within the scope of the present disclosure that the inner diameter of the sealing device sealing surface may be selected relative to an inner diameter of the casing conduit that is defined by the production casing and/or by the inner diameter of the housing conduit that is defined by housing body 112. As illustrative, non-exclusive examples, the inner diameter of the sealing device sealing surface may be at least 1%, at least 2%, at least 3%, at least 4%, at least 5%, at least 6%, at least 7%, or at least 8% of the inner diameter of the casing conduit. Additionally or alternatively, the inner diameter of the sealing device sealing surface also may be less than 15%, less than 14%, less than 13%, less than 12%, less than 11%, less than 10%, less than 9%, less than 8%, less than 7%, less than 6%, less than 5%, or less than 4% of the inner diameter of the casing conduit.

Figure 14:
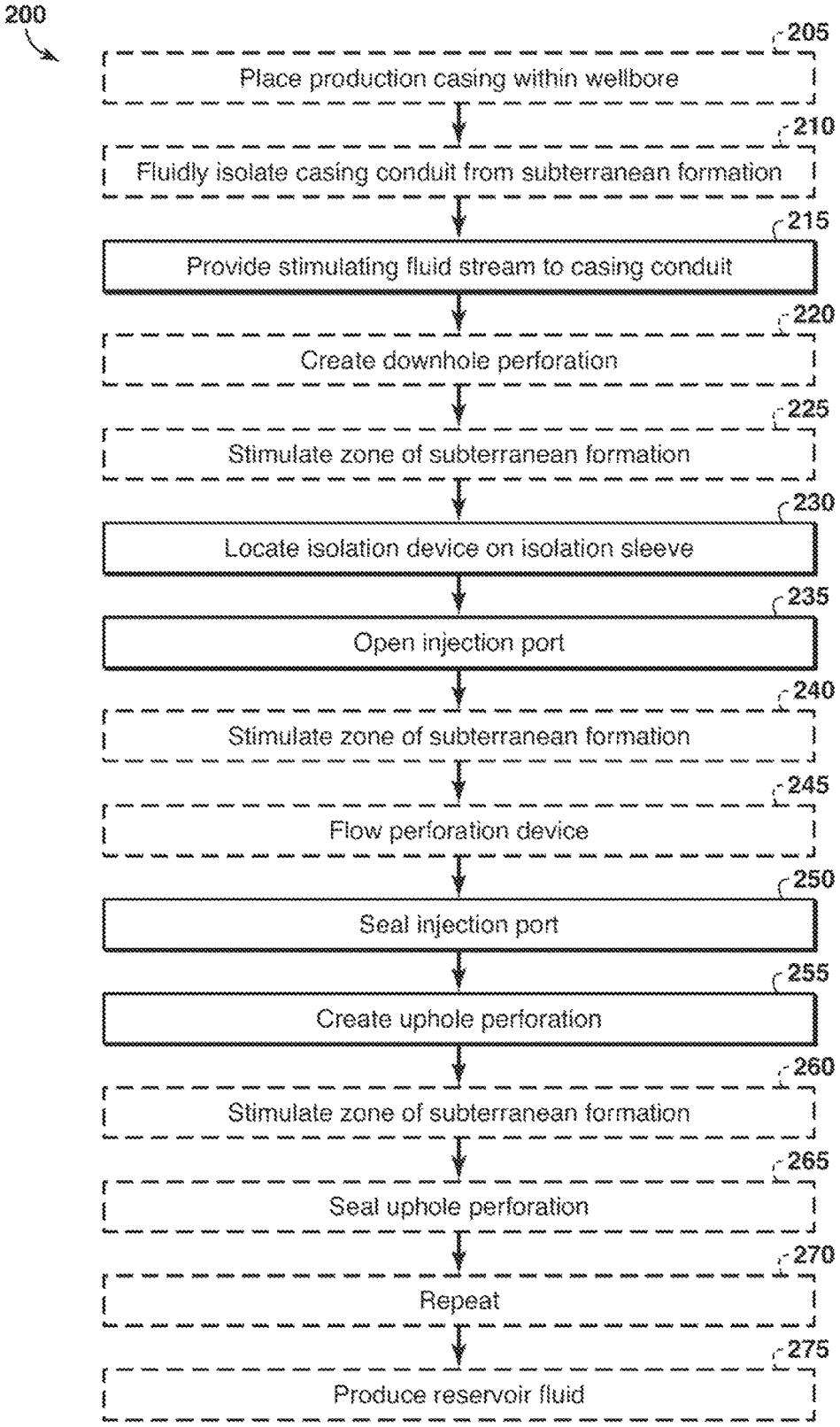
FIG. 14 is a flowchart depicting methods according to the present disclosure of stimulating a subterranean formation.

FIG. 14 is a flowchart depicting methods 200 according to the present disclosure of stimulating a subterranean formation. Methods 200 may include placing a production casing that defines a casing conduit within a wellbore that extends within the subterranean formation at 205 and/or fluidly isolating the casing conduit from the subterranean formation at 210. Methods 200 include providing a stimulating fluid stream to the casing conduit at 215 and may include creating a downhole perforation in a downhole longitudinal section of the production casing with a perforation device, which may be a first perforation device, at 220. Methods 200 further may include stimulating a zone of the subterranean formation at 225 and include locating an isolation device on an isolation sleeve at 230. Methods 200 also include opening an injection port that is associated with the isolation sleeve at 235 and may include stimulating a zone of the subterranean formation at 240 and/or flowing a perforation device, which may be a second perforation device, into the casing conduit at 245. Methods 200 also include sealing the injection port at 250 and creating an uphole perforation within an uphole longitudinal section of the production casing at 255. Methods 200 further may include stimulating a zone of the subterranean formation at 260, sealing the uphole perforation at 265, repeating at least a portion of the methods at 270, and/or producing a reservoir fluid from the subterranean formation at 275.

Placing the production casing within the wellbore at 205 may include sliding, translating, and/or otherwise locating the production casing within the wellbore. When methods 200 include the placing at 205, it is within the scope of the present disclosure that the methods further may include installing the isolation sleeve within the production casing prior to the placing at 205. This may include operatively attaching a first, or downhole, longitudinal section of the production casing to a second, or uphole, longitudinal section of the production casing with the isolation sleeve and/or operatively attaching the uphole longitudinal section of the production casing and/or the downhole longitudinal section of the production casing to the isolation sleeve.

Additionally or alternatively, it is also within the scope of the present disclosure that methods 200 may include installing the isolation sleeve within the production casing subsequent to the placing at 205. This may include translating and/or conveying the isolation sleeve within the casing conduit to install the isolation sleeve within the production casing and/or to locate the isolation sleeve between the uphole longitudinal section and the downhole longitudinal section.

Fluidly isolating the casing conduit from the subterranean formation at 210 may include limiting, restricting, blocking, and/or occluding fluid flow between the casing conduit and the subterranean formation and/or from the casing conduit into the subterranean formation. It is within the scope of the present disclosure that the fluidly isolating at 210 may be accomplished in any suitable manner.

As an illustrative, non-exclusive example, the fluidly isolating at 210 may include limiting, or even preventing, a flow of the stimulating fluid through a transverse cross-section of the production casing. As another illustrative, non-exclusive example, the fluidly isolating at 210 may include flowing an isolation plug through the casing conduit to a region of the casing conduit that is downhole from the downhole longitudinal section of the production casing and/or expanding the isolation plug in the region of the casing conduit that is downhole from the longitudinal section of the production casing. This may include flowing the isolation plug through the isolation sleeve and/or through a portion of the casing conduit that is defined by the isolation sleeve. As another illustrative, non-exclusive example, the fluidly isolating at 210 also may include forming and/or locating a fluid plug within the region of the casing conduit that is downhole from the downhole longitudinal section of the production casing.

As yet another illustrative, non-exclusive example, the fluidly isolating at 210 also may include locating a sealing device on an initial, or previously formed, perforation that is present within the production casing to restrict, limit, block, and/or occlude fluid flow through the initial perforation, between the casing conduit and the subterranean formation, and/or from the casing conduit to the subterranean formation. This may include flowing the sealing device past the first perforation device while the first perforation device is present within the casing conduit and/or providing the sealing device to the casing conduit from a surface region. As another illustrative, non-exclusive example, the fluidly isolating at 210 also may include actuating a valve, such as a hydraulically actuated valve.

When the fluidly isolating at 210 includes locating the sealing device, the providing at 215 may include providing the stimulating fluid prior to creation of the initial perforation, and methods 200 further may include pressurizing the casing conduit with the stimulating fluid prior to creation of the initial perforation. Methods 200 then may include creating the initial perforation within an initial perforated region of the casing conduit responsive to a fluid pressure within the casing conduit exceeding a threshold perforating pressure and/or flowing a portion of the stimulating fluid through the initial perforation to stimulate an initial zone of the subterranean formation.

It is also within the scope of the present disclosure that the fluidly isolating at 210 may be performed at any suitable time during methods 200. As an illustrative, non-exclusive example, the fluidly isolating at 210 may be performed prior to the creating at 220. As another illustrative, non-exclusive example, the fluidly isolating at 210 may include fluidly isolating prior to and/or concurrently with the providing at 215 and/or fluidly isolating to permit the fluid pressure within the casing conduit to increase above the threshold perforating pressure during the providing at 215.

Providing the stimulating fluid stream to the casing conduit at 215 may include providing the stimulating fluid stream to increase the fluid pressure within the casing conduit and/or to stimulate and/or fracture the zone of the subterranean formation. This may include continuously, or at least substantially continuously, providing the stimulating fluid stream during methods 200 (and/or during a remainder of methods 200). Additionally or alternatively, the providing at 215 also may include providing the stimulating fluid stream during and/or prior to the creating at 220, the locating at 230, the opening at 235, the sealing at 250, and/or the creating at 255.

Creating the downhole perforation in the downhole longitudinal section of the production casing at 220 may include creating the downhole perforation responsive to the fluid pressure within the casing conduit exceeding the threshold perforating pressure. It is within the scope of the present disclosure that the creating at 220 may include creating a single downhole perforation; however, it is also within the scope of the present disclosure that the creating at 220 may include creating a plurality of downhole perforations sequentially and/or simultaneously. In addition, the creating at 220 may include creating the downhole perforation with any suitable first perforation device, such as a perforation gun that includes a plurality of first perforation charges. Under these conditions, the creating at 220 may include discharging a portion of the plurality of first perforation charges to create the downhole perforation.

Stimulating the zone of the subterranean formation at 225 may include flowing at least a portion of the stimulating fluid stream from the casing conduit into the zone of the subterranean formation to stimulate the zone of the subterranean formation. Thereafter, the zone of the subterranean formation also may be referred to herein as a stimulated zone. As an illustrative, non-exclusive example, the zone of the subterranean formation may be a downhole zone of the subterranean formation that is associated with and/or proximal to the downhole perforation that is formed during the creating at 220, and the stimulating at 225 may include flowing the portion of the stimulating fluid stream through the downhole perforation to stimulate the downhole zone of the subterranean formation.

It is within the scope of the present disclosure that, when the stimulating at 225 includes fracturing the zone of the subterranean formation, methods 200 further may include providing a proppant to the (stimulated) zone of the subterranean formation. This may include providing any suitable proppant to any suitable zone of the subterranean formation (such as to the downhole zone of the subterranean formation via the downhole perforation). It is within the scope of the present disclosure that methods 200 may include retaining the first perforation device and/or the second perforation device within the casing conduit while providing the proppant, such as to prevent and/or mitigate screenout within the casing conduit. As an illustrative, non-exclusive example, methods 200 further may include perforating the production casing (or creating one or more additional perforations within the casing conduit) with the first perforation device and/or with the second perforation device responsive to the fluid pressure within the casing conduit exceeding a threshold screening pressure (such as may be caused by plugging of the downhole perforation and/or plugging of the uphole perforation while providing the proppant).

Locating the isolation device on the isolation sleeve at 230 may include locating the isolation device on any suitable isolation sleeve that defines a portion of the casing conduit. This may include fluidly isolating a downhole portion of the casing conduit, which may be defined by the downhole longitudinal section of the production casing, from an uphole portion of the casing conduit, which may be defined by the uphole longitudinal section of the production casing. The locating at 230 further may include positioning the isolation device on an isolation device seat that is defined by the isolation sleeve, and methods 200 also may include removing the first perforation device from the casing conduit prior to the locating at 230, such as to permit the isolation device to flow through the casing conduit and/or to permit the locating at 230.

Opening the injection port at 235 may include opening any suitable injection port that is associated with and/or defined by the isolation sleeve. The opening at 235 may be responsive to and/or based, at least in part, on the locating at 230. As an illustrative, non-exclusive example, the opening at 235 may be responsive to at least a threshold pressure differential being established across the isolation device subsequent to the locating at 230.

The opening at 235 further may include permitting an injection port fluid flow of the stimulating fluid stream through the injection port and/or from the casing conduit into the subterranean formation. This may include stimulating, at 240, a zone of the subterranean formation that is proximal to and/or associated with the isolation device and/or the injection port and may be at least substantially similar to the simulating at 225, which is discussed herein.

Flowing the second perforation device into the casing conduit at 245 may include flowing the second perforation device within the casing conduit and/or locating the second perforation device within the uphole section of the production casing in any suitable manner. As illustrative, non-exclusive examples, the flowing at 245 may include flowing concurrently with the injection port fluid flow, flowing subsequent to the locating at 230, and/or flowing subsequent to the opening at 235. As another illustrative, non-exclusive example, and as discussed herein, the flowing at 245 also may include flowing the second perforation device at least partially concurrently with the locating at 230. As yet another illustrative, non-exclusive example, and as also discussed herein, the second perforation device may be operatively attached to and/or may form a portion of the isolation device, and the flowing at 245 may include flowing an assembly that includes the second perforation device and the isolation device through the casing conduit.

Sealing the injection port at 250 may include sealing the injection port in any suitable manner to limit, block, occlude, and/or restrict the injection port fluid flow. As an illustrative, non-exclusive example, the sealing at 250 may include receiving an injection port sealing device on an injection port sealing device seat that defines a portion of the injection port to seal the injection port. As another illustrative, non-exclusive example, the sealing at 250 also may include forming and/or locating a fluid plug around, near, proximal to, and/or in contact with the injection port and/or the injection port sealing device. It is within the scope of the present disclosure that the sealing at 250 may include sealing prior to the creating at 255 and/or sealing to permit the fluid pressure within the casing conduit to exceed the threshold perforating pressure.

References herein to sealing the sleeve, injection port, and/or a perforation with an isolation device 120 or sealing device 170 may additionally or alternatively be referred to as temporarily sealing the sleeve, injection port, and/or perforation. Specifically, isolation devices 120 and sealing devices 170 may be configured to form a seal with the corresponding seat or engagement surface of the sleeve, injection port, and/or perforation when urged into sealing contact therewith, such as responsive to gravitational forces and/or fluid pressure within the casing conduit. However, the sealing/isolation devices may be configured to flow or otherwise be moved away from this sealing configuration/position relative to the sleeve, injection port, and/or perforation responsive to a decrease in this fluid pressure within the casing conduit uphole of the device and/or a greater fluid pressure (such as from downhole in the casing conduit and/or from the subterranean formation) urging the sealing/isolation device away from the sleeve, injection port, and/or perforation.

Creating the uphole perforation within the uphole longitudinal section of the production casing at 255 may include creating the uphole perforation with the second perforation device and/or creating the uphole perforation responsive to the fluid pressure within the casing conduit exceeding the threshold perforating pressure (such as may be a result of the providing at 215, the locating at 230, and/or the sealing at 250). It is within the scope of the present disclosure that the creating at 255 may include creating a single uphole perforation; however, it is also within the scope of the present disclosure that the creating at 255 may include creating a plurality of uphole perforations within the uphole longitudinal section of the production casing. Similar to the first perforation device, the second perforation device may include and/or be a second perforation gun that includes a plurality of second perforation charges. Thus, the creating at 255 further may include discharging one or more of the plurality of second perforation charges to create the uphole perforation(s).

It is within the scope of the present disclosure that the first perforation device may be separate, distinct, and/or different from the second perforation device. However, it is also within the scope of the present disclosure that at least a portion of the first perforation device may be re-used as the second perforation device, such as when the first perforation device is removed from the casing conduit prior to the locating at 230 and is subsequently re-inserted into the casing conduit prior to and/or during the flowing at 245 and/or prior to the creating at 255.

Stimulating the zone of the subterranean formation at 260 may include stimulating a zone of the subterranean formation that is proximal to and/or associated with the uphole perforation, and the stimulating may be accomplished in any suitable manner and/or with any suitable process. As illustrative, non-exclusive examples, the stimulating at 260 may be (i.e., occur) at least substantially similar to the stimulating at 225 and/or to the stimulating at 240.

Sealing the uphole perforation at 265 may include at least partially (and optionally substantially or even completely) sealing the uphole perforation in any suitable manner and may be performed subsequent to the creating at 255 and/or subsequent to the stimulating at 260. As an illustrative, non-exclusive example, the sealing at 265 may include receiving a sealing device, which also may be referred to herein as an uphole perforation sealing device, on the uphole perforation to at least partially block, occlude, and/or restrict fluid flow through the uphole perforation. As another illustrative, non-exclusive example, the sealing at 265 also may include at least partially (and optionally substantially or even completely) fluidly isolating the uphole portion of the casing conduit from the subterranean formation, such as to permit pressurization of the uphole portion of the casing conduit by the stimulating fluid stream. As yet another illustrative, non-exclusive example, the sealing at 260 also may include forming and/or locating a fluid plug around, near, proximal to, and/or in contact with the sealing device.

Repeating at least a portion of the methods at 270 may include repeating any suitable portion of methods 200 to create one or more additional perforations within the production casing and/or to stimulate one or more additional zones of the subterranean formation. As an illustrative, non-exclusive example, the repeating at 270 may include repeating the fluidly isolating at 210 to fluidly isolate the uphole portion of the casing conduit from the subterranean formation, repeating (or continuing) the providing at 215 to pressurize the uphole portion of the casing conduit, repeating the creating at 220 to create one or more additional perforations within the uphole longitudinal section of the production casing, repeating the locating at 230 to fluidly isolate the uphole portion of the casing conduit from the subterranean formation, repeating the creating at 255 to create one or more additional perforations within the uphole longitudinal section of the production casing, and/or repeating the sealing at 265 to seal the one or more additional perforations.

Producing the reservoir fluid from the subterranean formation at 275 may include producing the reservoir fluid from the subterranean formation in any suitable manner. This may include flowing the reservoir fluid from the subterranean formation, through the plurality of perforations that may be present within the production casing, through the casing conduit, and/or to (or at least proximal to and/or nearer) the surface region. It is within the scope of the present disclosure that the producing at 275 also may include removing one or more isolation devices from the casing conduit and/or removing one or more sealing devices from the casing conduit, such as by flowing the isolation devices and/or the sealing devices through the casing conduit and to the surface region with the reservoir fluid. It is also within the scope of the present disclosure that the producing at 275 may be performed subsequent to the creating at 255 and/or that methods 200 may include transitioning from the creating at 255 to the producing at 275 without removing an isolation plug from the casing conduit.

The systems and methods disclosed herein have been described in the context of an isolation device (such as isolation device 120) that is configured to form a fluid seal with an isolation device seat (such as isolation device seat 146). It is within the scope of the present disclosure that the isolation device may include, be, and/or be referred to herein as an isolation ball, an isolation unit, an isolation body, and/or an isolation structure. It is also within the scope of the present disclosure that the isolation device seat also may include, be, and/or be referred to herein as an isolation ball seat, an isolation seat, an isolation surface, a designated isolation surface, a designed isolation surface, an isolation body receptacle, an isolation device receptacle, and/or as an isolation structure receptacle.

Similarly, the systems and methods disclosed herein also have been described in the context of a sealing device (such as sealing device 170) that is configured to form a fluid seal with a sealing device seat (such as sealing device seat 116) that may include a sealing device sealing surface (such as sealing device sealing surface 117). It is within the scope of the present disclosure that the sealing device also may include, be, and/or be referred to herein as a ball sealer, a sealing unit, a sealing body, and/or a sealing structure. It is also within the scope of the present disclosure that the sealing device seat also may include, be, and/or be referred to herein as a ball sealer seat, a sealing seat, a sealing surface, a designated sealing surface, a designed sealing surface, a sealing body receptacle, a sealing device receptacle, a sealing unit receptacle, and/or a sealing structure receptacle.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and define a term in a manner or are otherwise inconsistent with either the non-incorporated portion of the present disclosure or with any of the other incorporated references, the non-incorporated portion of the present disclosure shall control, and the term or incorporated disclosure therein shall only control with respect to the reference in which the term is defined and/or the incorporated disclosure was originally present.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A method of stimulating a subterranean formation, the method comprising:

providing a stimulating fluid stream to a casing conduit that is defined by a production casing that extends within the subterranean formation to increase a fluid pressure within the casing conduit;

locating an isolation device with an isolation sleeve that defines at least a portion of the casing conduit to fluidly isolate a downhole portion of the casing conduit that is defined by a downhole longitudinal section of the production casing from an uphole portion of the casing conduit that is defined by an uphole longitudinal section of the production casing;

subsequent to the locating the isolation device, opening an injection port that is associated with the isolation sleeve to permit an injection port fluid flow of the stimulating fluid stream through the injection port from the casing conduit into the subterranean formation;

flowing the stimulating fluid stream through the opened injection port associated with the injection sleeve while a perforating device is positioned within the uphole portion of the casing conduit;

sealing the injection port to restrict the injection port fluid flow to the subterranean formation and to permit the fluid pressure within the casing conduit to increase to a wellbore pressure exceeding a threshold perforating pressure;

creating an uphole perforation in the uphole longitudinal section of the production casing using the perforating device responsive to an indication that the injection port has been sealed as indicated by an increase in the fluid pressure within the uphole portion of the casing conduit; and flowing the stimulating fluid stream through the created uphole perforation.

2. The method of claim 1, wherein, prior to the locating, the method further includes creating a downhole perforation in the downhole longitudinal section of the production casing responsive to the fluid pressure exceeding the threshold perforating pressure.

3. The method of claim 2, wherein, prior to the creating the downhole perforation, the method further includes fluidly isolating the casing conduit from the subterranean formation.

4. The method of claim 3, wherein the fluidly isolating includes fluidly isolating the casing conduit from the subterranean formation to permit the fluid pressure to increase above the threshold perforating pressure.

5. The method of claim 3, wherein the fluidly isolating includes flowing an isolation plug through the casing conduit and to a region of the casing conduit that is downhole from the uphole longitudinal section of the production casing.

6. The method of claim 3, wherein the fluidly isolating includes locating an initial sealing device on an initial perforation that is present within the production casing to limit fluid flow through the initial perforation between the casing conduit and the subterranean formation.

7. The method of claim 6, wherein, prior to the fluidly isolating, the method further includes:

providing the stimulating fluid stream to the casing conduit;

creating the initial perforation in an initial perforated region of the downhole longitudinal section of the production casing with the perforation device; and flowing a portion of the stimulating fluid stream through the initial perforation to stimulate an initial zone of the subterranean formation.

8. The method of claim 6, wherein locating the initial sealing device includes locating an initial ball sealer on the initial perforation.

9. The method of claim 1, wherein the providing includes at least substantially continuously providing the stimulating fluid stream during the method.

10. The method of claim 1, wherein the locating the isolation device includes positioning the isolation device on an isolation device seat that is defined by the isolation sleeve, and further wherein the locating the isolation device includes flowing the isolation device from a surface region to the isolation sleeve to locate the isolation device on the isolation sleeve.

11. The method of claim 1, wherein the method further includes flowing a perforation device from a surface region into the casing conduit, wherein the flowing the perforation device is at least one of (i) performed concurrently with the locating the isolation device, (ii) performed subsequent to the locating the isolation device, and (iii) performed concurrently with the injection port fluid flow.

12. The method of claim 1, wherein the method further includes stimulating a zone of the subterranean formation by flowing a portion of the stimulating fluid stream from the casing conduit into the zone of the subterranean formation through the uphole perforation.

13. The method of claim 12, wherein the method further includes providing a proppant to the zone of the subterranean formation.

14. The method of claim 13, wherein the method further includes retaining a perforation device within the casing conduit during the providing the proppant.

15. The method of claim 14, wherein, during the providing the proppant, the method further includes perforating the production casing with the perforation device responsive to the fluid pressure exceeding a threshold screenout pressure.

16. The method of claim 1, wherein, prior to the creating the uphole perforation, the method further includes flowing a perforation device from a surface region into the casing conduit concurrently with the injection port fluid flow.

17. The method of claim 16, wherein the sealing the injection port includes receiving an injection port sealing device on an injection port sealing device seat that defines a portion of the injection port.

18. The method of claim 17, wherein receiving an injection port sealing device includes receiving a ball sealer on the injection port sealing device seat.

19. The method of claim 1, wherein locating an isolation device includes locating an isolation ball on the isolation sleeve to fluidly isolate the downhole portion of the casing conduit.

20. The method of claim 1, wherein the method further includes producing a reservoir fluid from the subterranean formation via the casing conduit, wherein the producing is subsequent to the creating the uphole perforation, and further wherein the method includes transitioning from the creating the uphole perforation to the producing without removing an isolation plug from the casing conduit.

21. The method of claim 1, wherein the method further includes:

determining that at least one component of a well that is performing the method has malfunctioned;

providing a sealing fluid to the casing conduit responsive to the determining;

flowing the sealing fluid to a perforated section of the production casing that includes an existing perforation; and generating a fluid plug within the perforated section of the production casing by increasing a viscosity of the sealing fluid.

22. The method of claim 21, wherein the method further includes:

providing an existing perforation sealing device to the casing conduit responsive to the determining;

flowing the existing perforation sealing device to the perforated section of the production casing;

locating the existing perforation sealing device on the existing perforation to at least partially seal the existing perforation; and retaining the existing perforation sealing device proximate the existing perforation with the fluid plug.

23. A well, comprising:

a wellbore that extends between a surface region and a subterranean formation;

a production casing that extends within the wellbore and defines a casing conduit, wherein the production casing includes a downhole longitudinal section and an uphole longitudinal section;

an isolation sleeve that defines a portion of the casing conduit and is located between the downhole longitudinal section of the production casing and the uphole longitudinal section of the production casing, wherein the isolation sleeve is associated with an injection port and is configured to selectively permit fluid communication between the casing conduit and the subterranean formation via the injection port;

an isolation device engaged with the isolation sleeve;

a perforation in the production casing;

a sealing device that is located on the perforation, wherein the sealing device limits fluid flow through the perforation from the casing conduit to the subterranean formation; and a perforation device that is located within the uphole portion of the casing conduit while the isolation device engages the isolation sleeve.

24. The well of claim 23, wherein the sealing device is a ball sealer.

25. The well of claim 23, wherein the perforation device is located downhole from the isolation sleeve.

26. The well of claim 23, wherein the perforation device is located uphole from the isolation sleeve, and further wherein the isolation device is located on the isolation sleeve and fluidly isolates a first portion of the casing conduit that is defined by the downhole longitudinal section of the production casing from a second portion of the casing conduit that is defined by the uphole longitudinal section of the production casing.

27. The well of claim 26, wherein the isolation device is an isolation ball that is located on the isolation sleeve.

28. The well of claim 23, wherein the perforation is a downhole perforation that is defined within the downhole longitudinal section of the production casing.

29. The well of claim 23, wherein the production casing defines a plurality of perforations, wherein the well includes a plurality of sealing devices, and further wherein a respective sealing device of the plurality of sealing devices is located on each perforation of the plurality of perforations.

30. The well of claim 23, wherein the well further includes a free sealing device located in an annular space that is defined between the production casing and the perforation device.

31. The well of claim 23, wherein the well further includes a stimulating fluid supply system that is configured to provide a stimulating fluid stream to the casing conduit.

32. The well of claim 31, wherein the well further includes a pressure detector that is configured to detect a fluid pressure of the stimulating fluid stream.

33. The well of claim 23, wherein the well further includes a perforation device control structure that controls the operation of the perforation device, wherein the perforation device control structure is selected to automatically actuate the perforation device to create a perforation in the production casing responsive to the fluid pressure exceeding at least one of (i) a threshold perforating pressure and (ii) a threshold screenout pressure.

34. The well of claim 23, wherein the isolation sleeve is a flow control assembly that is configured to control a fluid flow within the casing conduit, wherein the flow control assembly includes:

a housing that includes:

a housing body that defines at least a portion of an outer surface of the housing and at least a portion of an opposed inner surface of the housing, wherein the inner surface defines a housing conduit that forms a portion of the casing conduit;

an injection conduit that extends through the housing body between the housing conduit and the subterranean formation; and a sealing device seat that defines a portion of the injection conduit, is defined on the inner surface of the housing, and is sized to receive a sealing device to restrict fluid flow from the casing conduit through the injection conduit;

a sliding sleeve that is located within the housing conduit and is configured to transition between a first configuration, in which the sliding sleeve resists an injection conduit fluid flow through the injection conduit, and a second configuration, in which the sliding sleeve permits the injection conduit fluid flow through the injection conduit, wherein the sliding sleeve includes an isolation device seat that is configured to receive an isolation device to restrict fluid flow from a portion of the casing conduit that is uphole from the flow control assembly to a portion of the casing conduit that is downhole from the flow control assembly; and a retention structure that is configured to retain the sliding sleeve in the first configuration and to selectively permit the sliding sleeve to transition from the first configuration to the second configuration when the isolation device is located on the isolation device seat and a pressure differential across the isolation device is greater than a threshold pressure differential.

* * * * *